US005981430A

United States Patent [19]

Sam et al.

[11] Patent Number: 5,981,430

[45] Date of Patent: Nov. 9, 1999

[54] THERMAL PRINTING SHEET

[75] Inventors: Huy Sam, Tokyo; Masayoshi Isago, Miyagi; Kei Obata, Miyagi; Hiroaki Ogasawara, Miyagi, all of Japan

[73] Assignee: Sony Corporation, Tokyo, Japan

[21] Appl. No.: 09/041,690

[22] Filed: Mar. 13, 1998

[30] Foreign Application Priority Data

Mar. 14, 1997 [JP] Japan ..... P09-061482
Aug. 20, 1997 [JP] Japan ..... P09-224100

[51] Int. Cl.[6] ..... B41M 5/035; B41M 5/38

[52] U.S. Cl. ..... 503/227; 428/913; 428/914

[58] Field of Search ..... 8/471; 428/195, 428/423.1, 500, 913, 914; 503/227

[56] References Cited

U.S. PATENT DOCUMENTS 4,981,748 1/1991 Kawai et al. ..... 428/216

*Primary Examiner*—Bruce H. Hess
*Attorney, Agent, or Firm*—Hill & Simpson

[57] ABSTRACT

The present invention provides a thermal printing sheet which enables to realize a stable low friction coefficient within a heating range by a thermal head and which has a superior preservation stability without giving an adverse affect to dye layers.

The thermal printing sheet according to the present invention includes a substrate sheet 1, on one side of which are formed thermal dye layers 2 and on the other side of which is formed a heat resistant slide layer 3. The heat resistant slide layer 3 contains polyoxyalkylene sorbite fatty acid ester which exhibits a superior lubrication characteristic, enabling to obtain a low friction coefficient even under a high temperature. Moreover, the polyoxyalkylene sorbite fatty acid ester is neutral and does no adversely affect the dye layers. The heat resistant slide layer 3, in addition to the polyoxyalkylene sorbite fatty acid ester, may contain polyglycerin fatty acid ester and metallic soap.

11 Claims, 3 Drawing Sheets

THERMAL PRINTING SHEET

BACKGROUND OF THE INVENTION

1. Field of the Invention

The present invention relates to a thermal printing sheet and in particular, to a thermal printing sheet having a superior running feature and a superior preservation stability.

2. Description of the Prior Art

The thermal method using sublimating dyes transfers a plenty of color dots by heating within a significantly short time so as to express a full color image using the color dots of various colors.

In this thermal method, as a thermal printing sheet is used a so-called sublimating heat-transfer sheet consisting of a substrate sheet made from a polyester film or the like, on one side of which are formed dye layers made from sublimating dyes and binder.

In the aforementioned thermal method, the thermal printing sheet is heated from its back by a thermal head according to the image information, so as to transfer the dye from the dye layers onto a printing paper, forming an image.

When carrying out a printing on a printing paper by using the thermal printing sheet, a heat is applied to the heat resistant slide layer from the thermal head so as to transfer dye from the dye layers of the thermal printing sheet onto the printing paper, the color formation concentration is in proportion to the heat quantity, according to which the surface temperature of the thermal head varies by several hundred degrees. For this, while the thermal printing sheet moves along the thermal head, the friction coefficient between the thermal head and the heat resistant slide layer is easily changed according to the temperature change. If the friction coefficient between the thermal head and the heat resistant slide layer changes, the thermal printing sheet cannot travel at a constant velocity, disabling to obtain a clear image.

For example, when the friction coefficient is large, the thermal printing sheet temporarily moves at a reduced speed, for which portion the concentration is increased, causing a so-called sticking (line-shaped printing disorder).

In order to prevent this sticking, it is necessary to reduce the friction coefficient especially at a higher temperature. Conventionally, phosphoric ester has been used as a lubricant for reducing the friction coefficient under a high temperature.

However, the phosphoric ester is a strong acid and the use of this phosphoric ester in the heat resistant slide layer causes various troubles are caused.

For example, when a thermal printing sheet is preserved in a rolled state, the dye layers are brought into contact with the heat resistant layer, and especially when preserved at a high temperature, the phosphoric ester dissolves a portion of the dye from the dye layers, causing a concentration decrease during a printing as well as a printing unevenness.

Moreover, when a lubricant of a strong acidity such as phosphoric ester is used, a dye which is easily subjected to a chemical reaction including decomposition in an acid environment such as indoaniline pigment is easily deteriorated, causing a color formation change and decreasing the transfer concentration.

SUMMARY OF THE INVENTION

It is therefore an object of the present invention to provide a thermal printing sheet which enables a stable low friction coefficient in the heat ring caused by a thermal head and which exhibits a superior preservation stability without adversely affecting the dye layers.

In order to achieve the aforementioned object, the thermal printing sheet according to the present invention includes a substrate sheet, on one side of which are formed thermal dye layers and on the other side of which is formed a heat resistant slide layer containing polyoxyalkylene sorbite fatty acid ester.

The polyoxyalkylene sorbite fatty acid ester exhibits a superior lubrication and enables to obtain a low friction coefficient even under a high temperature.

Moreover, the polyoxyalkylene sorbite fatty acid ester is neutral, not showing an adverse affect to the dye layers.

DETAILED DESCRIPTION OF THE PREFERRED EMBODIMENTS

Figure 1:
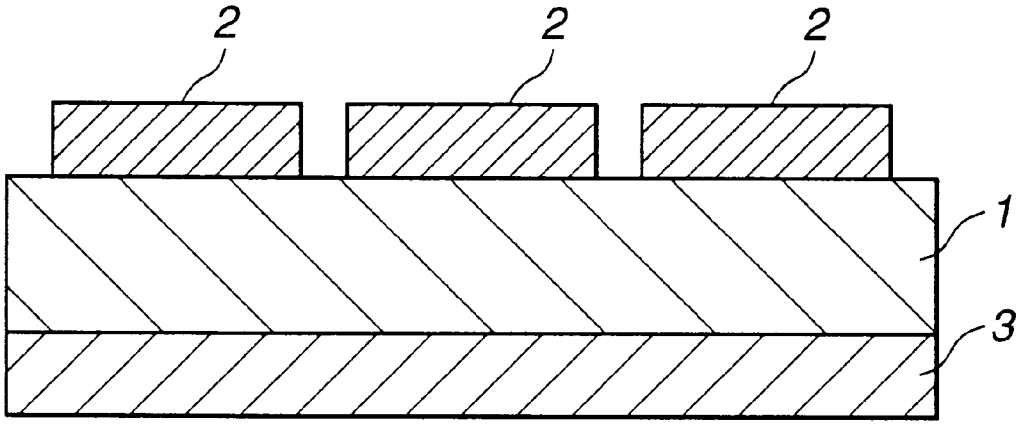
FIG. 1 is a cross sectional view showing an example of a thermal printing sheet.

FIG. 1 shows a thermal printing sheet according to an embodiment of the present invention, including a substrate sheet 1 having thermal dye layers 2 formed on one side of the substrate sheet 1 and a heat resistant slide layer 3 formed on the other side of the substrate sheet 1.

The substrate sheet may be made from a conventional substrate material such as a polyester film, a polystyrene film, polypropylene film, a polysulfone film, a polycarbonate film, a polyimide film, an aramide film, and the like. The substrate sheet may have a arbitrary thickness, for example, 1 to 30 $\mu$m, but preferably, 2 to 10 $\mu$m.

On one side of the substrate sheet 1 facing to a printing paper is formed the thermal dye layers 2, which are formed as a single continuous layer over the entire surface of the substrate sheet 1 in a case of a single color. In order to obtain a full color image, Yellow, Magenta, and Cyan dye layers 2 are successively formed, separately from one another.

Figure 2:
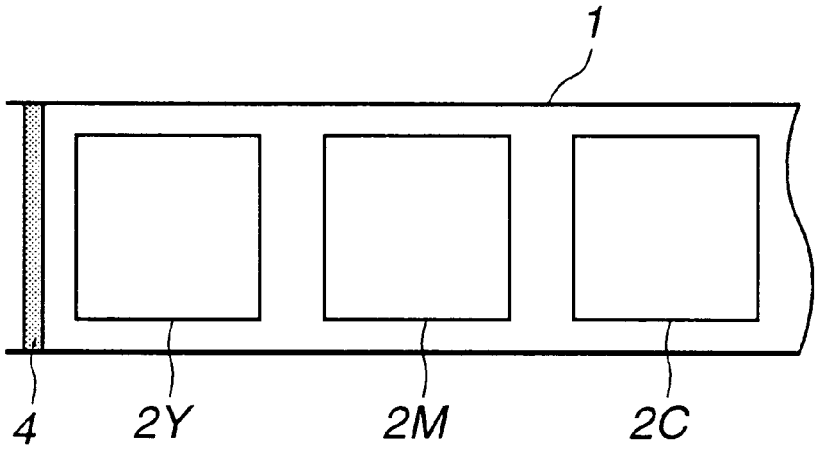
FIG. 2 is a plan view showing an example of a thermal printing sheet.

FIG. 2 shows an example of the thermal printing sheet having a detection mark 4, a Yellow dye layer 2Y, a Magenta dye layer 2M, a Cyan dye layer 2C which are formed repeatedly.

Figure 3:
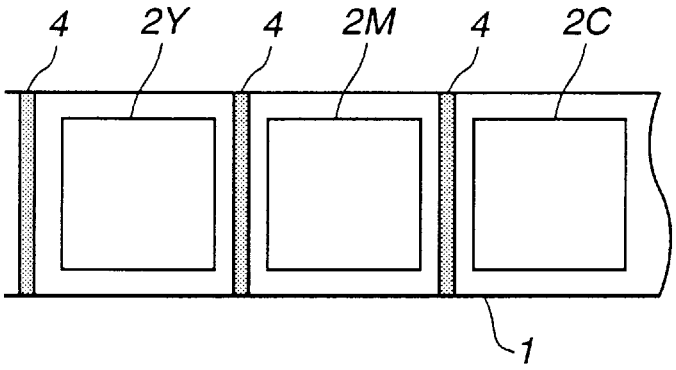
FIG. 3 is a plan view showing an example of a thermal printing sheet having a detection mark between the dye layers.

The Yellow, Magenta, and Cyan layers may be formed in an order other than the aforementioned. Moreover, it is possible to repeat four colors of Yellow, Magenta, Cyan, and Black. Furthermore, as shown in FIG. 3, the detection mark 4 may be provided between each two dye layers 2.

Figure 4:
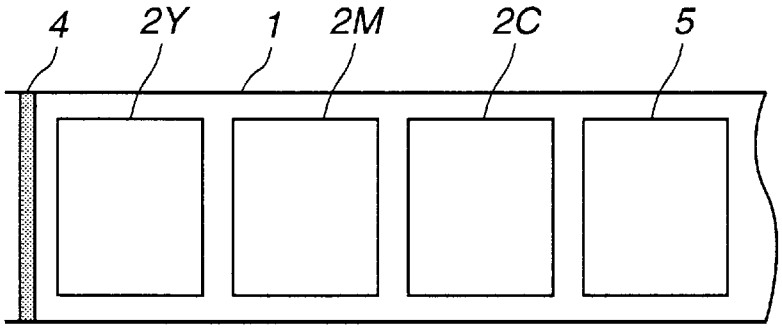
FIG. 4 is a plan view showing an example of a thermal printing sheet having a protection layer.
Figure 5:
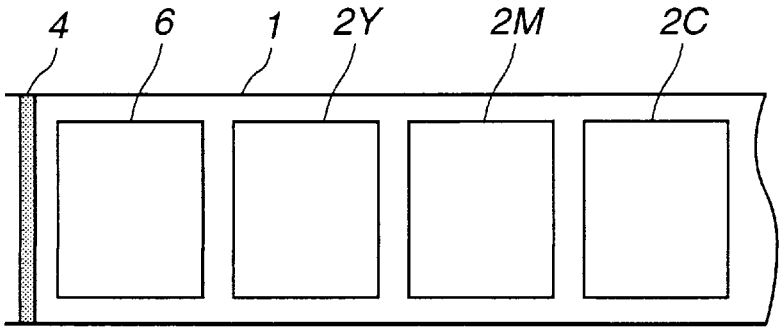
FIG. 5 is a plan view showing an example of a thermal printing sheet having a reception layer.

Moreover, as shown in FIG. 4, after the repetition of the thermal dye layers 2, it is possible to provide a transparent protection layer 5 for protecting a printing surface after printing. Alternatively, as shown in FIG. 5, it is possible, prior to the repetition of the thermal dye layer 2, to provide a thermal reception layer 6 for forming a reception layer on an ordinary paper prior to transfer of the thermal dye layers 2 when printing on an ordinary paper.

The aforementioned thermal dye layer 2 consists of at least a color dye and binder. Here, the binder may be selected from conventional binders: a water-soluble resin such as cellulose, acrylic acid, starch, and the like; an organic solvent soluble resin such as acrylate resin, polyphenylene oxide, polysulfone, polyethersulfone, acetylcellulose, or a resin soluble in water, and the like. When considering the recording sensitivity and the stability of a transferred body, it is preferable that the thermal deformation temperature be 70 to 150° C. and accordingly, it is preferable to use polystyrene, polyvinyl butyral, polycarbonate, methacrylic resin, acrylonitrile·styrene copolymer, polyester resin, urethane resin, polyethylene chloride, and the like.

The dye also may be an arbitrary one. For example, the Yellow dye may be azo, disazo, methine, pyridone azo, and the like as a single substance or in combination; the Magenta dye may be azo, anthraquinone, styryl, heterocyclic azo pigment as a single substance or in combination; the Cyan dye may be indoaniline, anthraquinone, naphthoquinone, heterocyclic azo pigment as a single substance or in combination.

On the other hand, the heat resistant slide layer 3 is provided on the other side of the substrate sheet 1 for running in contact with a thermal head.

The present invention is characterized in that this heat resistant slide layer 3 contains polyoxyalkylene sorbite fatty acid ester.

The polyoxyalkylene sorbite fatty acid ester is a compound expressed by Chemical Formula 3.

[Chemical Formula 3]

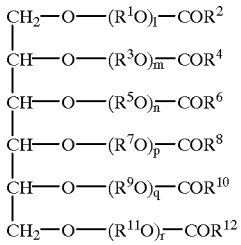

(wherein, $R^1$, $R^3$, $R^5$, $R^7$, $R^9$, and $R^{11}$ represent straight chain or branched chain alkyl groups of $C_2$ to $C_{10}$; $R^2$, $R^4$, $R^6$, $R^8$, $R^{10}$, and $R^{12}$ represent straight chain acyl groups of $C_{12}$ to $C_{30}$; l, m, n, p, q, and r are integers from 0 to 100 excluding a case when all of l, m, n, o, p, q, and r are zero.)

Among these compounds, a compound having "6" for the number of stearic acid esters and the oxyalkylene chains ( l, m, n, p, q, r) exhibits a high effect, and the hexastearic acid polyoxyethylene (6) sorbite expressed in Chemical Formula 4 below exhibits the highest effect in the dye preservation stability and the like.

[Chemical Formula 4]

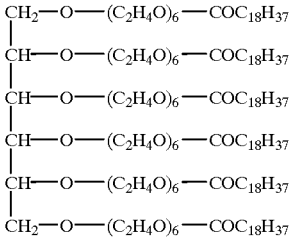

The aforementioned polyoxyalkylene sorbite fatty acid ester is preferably added within 5 to 50 weight %. If this content is below 5 weight %, it is impossible to obtain a sufficient effect and the friction reduction effect is insufficient. On the contrary, if the content exceeds 50 weight %, it becomes difficult to maintain the coating characteristic of the heat resistant slide layer 3 and this may adversely affect the dye preservation stability as well.

The aforementioned heat resistant slide layer 3 may contain, in addition to the aforementioned polyoxyalkylene sorbite fatty acid ester, polyglycerin fatty acid ester expressed by Chemical Formula 5 below. Addition of this compound further reduces the friction coefficient.

[Chemical Formula 5]

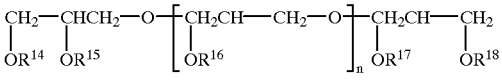

(wherein $R^{14}$, $R^{15}$, $R^{16}$, $R^{17}$, and $R^{18}$ represent hydrogen atoms or straight chain acyl groups of $C_{12}$ to $C_{18}$ excluding a case when all of the $R^{14}$, $R^{15}$, $R^{16}$, $R^{17}$, and $R^{18}$ are simultaneously hydrogen atoms; and n represents an integer from 0 to 10.)

As such a polyglycerin fatty acid ester, there can be exemplified dioleic acid diglyceryl, pentastearic acid tetraglyceryl, monolauric acid decaglyceryl, and the like.

The amount of this polyglycerin fatty acid ester to be added is preferably equal to or below 50% of the content of the total of the fatty acid esters (total of the polyoxyalkylene sorbite fatty acid ester and the polyglycerine fatty acid ester). If the content of the polyglycerine fatty acid ester exceeds 50%, the ratio of the polyoxyalkylene sorbite fatty acid ester is decreased and the friction coefficient at a higher temperature is increased. It should be noted that when both of the polyoxyalkylene sorbite fatty acid ester and the polyglycerin fatty acid ester are added, the total amount of these fatty acid esters is preferably equal to or below 50 weight %.

Furthermore, the aforementioned heat resistant slide layer 3 may be added with a mixture of the aforementioned polyoxyalkylene sorbite fatty acid ester and metallic soap expressed by Chemical Formula 6 given below. The addition of this mixture further reduces the friction coefficient.

[Chemical Formula 6 ]

$$(R^{13}COO)_nM\cdot X(H_2O)$$

(wherein $R^{13}$ represent a straight chain or branched chain alkyl group of $C_6$ to $C_{29}$ or alkyl group partially replaced by a hydroxyl group, amine, halogen group; n is an integer 1 to 4; M is a divalent to tetravalent metal; and X is an integer 0 to 4.)

The aforementioned mixture of the polyoxylalkylen sorbite fatty acid ester (a) and the metallic soap (b) preferably has a mixing ratio (a:b) of 10:0.01 to 1:1 in weight ratio. If the metallic soap has a higher mixing ratio, the solubility in an organic solvent is decreased and the external view of the coating is deteriorated.

Moreover, for mixing the aforementioned polyoxylalkylene sorbite fatty acid ester and the metallic soap, the mixture within the aforementioned mixing ratio is uniformly solved in an organic solvent such as toluene, xylene , methylethyl ketone, and the like, after which the solvent is removed. Alternatively, there is also a method to uniformly solve the mixture in a non-solvent system in an atmosphere of an inactive gas using heat, laser beam, electromagnetic wave, or the like.

The metallic soap expressed by the aforementioned Chemical Formula 6 is a hydrate or anyhydride. The fatty acid ($R^{13}COO$) is a higher fatty acid such as lauric acid, palmitylic acid, stearic acid, oleic acid, arachic acid, behenic acid, and melissic acid, or a fatty acid having a long chain alkyl group partially replaced by a hydroxyl group or amine, or a fatty acid having a branched long alkyl.

As the metal salt of the aforementioned metallic soap, there can be exemplified a divalent metal such as Cu, Be, Mg, Ca, Sr, Ba, Zn, Cd, Fe, Pb, Cr, Mn, Co, Ni, and the like; a trivalent metal such as Al, Ce, Fe, and the like; or a tetravalent metal such as Ti, Zr, and the like. Any one of these can be used as a single substance or it is also possible to use some of them in combination.

Especially as the aforementioned metallic soap, what is preferably used is a stearic acid metal having a functional group $R^{13}$ expressed by $C_{17}H_{35}$ $[(C_{17}H_{35}COO)_nM.xH_2O]$ such as iron stearate, aluminium stearate, cerium stearate, and titanium stearate.

The aforementioned metallic soap preferably has a melting point of 60 to 200° C. both for a single substance or a combination of several substances.

It should be noted that a total amount of the mixture of the polyoxyalkylene sorbite fatty acid ester and the metallic soap to be added is preferably 5 to 50 weight %. Moreover, as has been described above, in addition to this mixture, it is possible to further add polyglycerin fatty acid.

By the way, the aforementioned heat resistant slide layer 3 is a layer containing as a main content a binder having an excellent heat resistance, to which the aforementioned fatty acid ester is added. As a binder, any of the conventional known ones can be used such as cellulose acetate, polyvinyl acetal, acrylic resin, and the like.

Moreover, when considering the heat resistance stability and the like, this binder is preferably bridged by a polyisocyanate compound. Especially by simultaneously bridging the aforementioned polyoxyalkylene sorbite fatty acid ester and the polyglycerin fatty acid ester, it is possible to form the heat resistant slide layer 3 capable of exhibiting a significantly stable lubrication effect.

As the polyisocyanate compound, it is possible to use isocyanate compound having at least two isocyanate groups in a molecule, such as tolylendiisocyanate, 4,r'-diphenylmethanediisocyanate, 4,4'-xylenediisocyanate, hexamethylenediisocyanate, 4,4'-methylenebis (cyclohexylisocyanate), methylcyclohexane-2,4-diisocyanate, methylcyclohexane-2,6-diisocyanate, 1,3 -di (isocyanatemethyl)cyclohexane, isophoronediisocyanate, trimethyl·hexamethylenediisocyanate, and the like, or an adduct (polyisocyanateprepolymer) obtained by a partial reaction between diisocyanate and polyol, such as an adduct obtained by a reaction between tolylendiisocyanate and trimethylolpropane.

The aforementioned heat resistance slide layer 3, in addition to the aforementioned binder, may contain various lubricants and bulking agents.

As the bulking for the heat resistant slide layer, it is possible to use inorganic bulking agents such as silica, talc, clay, zeolite, titanium oxide, zinc oxide, carbon, and the like; and organic bulking agents such as silicone resin, teflon resin, benzoguanamine resin, and the like.

However, these bulking agents are added too much, a drying defect may be caused during a film formation of the heat resistant slide layer 3 or blocking may be caused in a rolled state.

Description will now be directed specific examples with detailed explanation on experiment results.

Examples 1 to 10 and Comparative Examples 1 and 2

A thermal printing sheet was prepared by a procedure as follows.

Firstly, a polyester film of 6 μm thickness (trade name: Lumiller produced by Toray Co., Ltd.) was used as the substrate sheet, one side of which was coated with an ink having a composition described below, so as to have a thickness of 1 μm after dried.

| | | |
|---|---|---|
| Yellow ink | | |
| Foron Yellow (produced by Sandos Co., Ltd.) | 5.0 | weight parts |
| Polyvinylbutyral resin (trade name BX-1 produced by Sekisui Kagaku, Co., Ltd.) | 5.0 | weight parts |
| Methylethylketone | 45.0 | weight parts |
| Toluene | 45.0 | weight parts |
| Magenta ink | | |
| Foron Red | 2.5 | weight parts |
| Anthraquinone dye (trade name: ESC451 produced by Sumitomo Kagaku Co., Ltd.) | 2.5 | weight parts |
| Polyvinylbutyral resin (trade name: BX-1 produced by Sekisui Kagaku Co., Ltd.) | 5.0 | weight parts |
| Methylethylketone | 45.0 | weight parts |
| Toluene | 45.0 | weight parts |
| Cyan ink | | |
| Foron Blue (produced by Sandos Co., Ltd.) | 2.5 | weight parts |
| Indoaniline dye (expressed by Chemical Formula 7) | 2.5 | weight parts |
| Polyvinylbutyral resin (trade name: BX-1 produced by Sekisui Kagaku co., Ltd.) | 5.0 | weight parts |

-continued

| | | |
|---|---|---|
| Methylethylketone | 45.0 | weight parts |
| Toluene | 45.0 | weight parts |

[Chemical Formula 7]

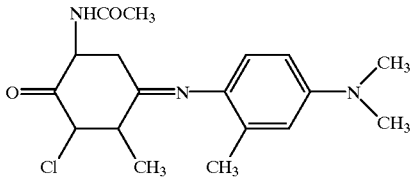

Next, a heat resistant slide layer having a composition described below was applied to the other side of the substrate sheet not having the aforementioned dye layers, so as to have a thickness of 1 μm after dried, thus obtaining a thermal printing sheet.

| Composition of the Heat resistant slide layer | | |
|---|---|---|
| Polyvinylacetal resin (trade name: Denkabutyral #3000K produced by Denki Kagaku Kogyou Co., Ltd.) | 5.0 | weight parts |
| Polyisocyanate (trade name: Colonate L produced by Nippon Polyurethane Kogyo Co., Ltd.) | 0.5 | weight parts |
| Spherical silica (Tospal 105 produced by Toshiba Silicone Co., Ltd.) | 0.1 | weight parts |

For the aforementioned composition, the type and quantity of polyoxyalkylene sorbite fatty acid ester shown in Table 1 was added to be mixed. The quantity of the aforementioned composition was adjusted so as to have a total of 100 weight parts. The mixture was applied to the substrate sheet.

It should be noted that in Table 1, Nikkol GS-6 (trade name) produced by Nikko Chemicals Co., Ltd. was used as the hexastearic acid polyoxyethylene (6) sorbite; Nikkol GS-460 (trade name) produced by Nikko Chemicals Co., Ltd. was used as the hexastearic acid polyoxyethylene (60) sorbite; and the other polyoxyalkylene sorbite fatty acid esters were prepared by ourselves.

Comparative Examples 3 to 5

Instead of the poolyoxyalkylene sorbite fatty acid ester, a polyglycerin fatty acid ester and phosphoric acid ester were added to prepare the thermal printing sheet in the same way as in Examples 1 to 12.

Note that Example 1 used myristic acid (Lunac MY-98 produced by Kao Co., Ltd.); Example 2 used stearic acid butyl (Nikkol BS produced by Nikko Chemicals Co., Ltd.); Example 3 used pentastearic acid hexaglyceryl (Nikkol Hexaglyn-55 produced by Nikko Chemicals Co., Ltd.); Example 4 used phosphoric acid ester (Phosphanol RL-210 produced by Toho Kagaku Kogyo Co., Ltd.); and Example 5 used phosphoric acid ester (Phosphanol RL-710 produced by Toho Kagaku Kogyou Co., Ltd.).

For the aforementioned samples, running smoothness, sticking, and dye preservation stability were checked.

That is, each of the thermal printing sheets obtained was mounted on a full color printer (trade name: UP-D7000) produced by Sony Co., Ltd. and printing was carried out (with 16 gradation steps) on a printing paper (trade name: UPC7010 produced by Sony Co., Ltd. Visual check was made to determine the running smoothness (printing uniformity, wrinkle generation, slipped printing) and sticking. The running smoothness was evaluated by a circle (o) if preferable and by a cross (x) if wrinkles were generated. Sticking was evaluated by a circle (o) if no sticking was caused and by a cross (x) if sticking was caused.

Moreover, the dye preservation stability was checked as follows. A thermal printing sheet obtained ( 20 cm×20 cm) was placed on another thermal printing sheet obtained so that the dye layers of one sheet face the heat resistant slide layer of the other and the two sheets were sandwiched between two glass plates, which were pressed downward by a 5 kg load from above and preserved in an oven at 50° C. for 48 hours. The thermal printing sheets before and after the preservation were mounted on the full color printer produced by Sony Co., Ltd. (trade name: UP-D7000) and printing was carried out (with 16 gradation steps) on a printing paper and a Macbeth illuminometer (trade name: TR-924) was used to determine the maximum concentration of the respective colors. A calculation was made to determine the Maximum concentration after preservation/Maximum concentration before preservation ×100 (%) so as to evaluate the dye preservation stability. Table 1 shows the results.

TABLE 1

| | Polyoxyethylene sorbite fatty acid ester | Weight parts | A* | B* | C* |
|---|---|---|---|---|---|
| Example 1 | Hexastearic acid polyoxyethylene (6) sorbite | 30 | ○ | ○ | 100 |
| Example 2 | Hexastearic acid polyoxyethylene (6) sorbite | 20 | ○ | ○ | 100 |
| Example 3 | Hexastearic acid polyoxyethylene (6) sorbite | 10 | ○ | ○ | 100 |
| Example 4 | Hexastearic acid polyoxyethylene (60) sorbite | 30 | ○ | ○ | 95 |
| Example 5 | Hexastearic acid polyoxyethylene (30) sorbite | 30 | ○ | ○ | 98 |
| Example 6 | Hexastearic acid polyoxyethylene (40) sorbite | 30 | ○ | ○ | 98 |
| Example 7 | Hexastearic acid polyoxyethylene (60) sorbite | 30 | ○ | ○ | 94 |
| Example 8 | Hexastearic acid polyoxyethylene (6) sorbite | 20 | ○ | ○ | 98 |
| | Tetrastearic acid polyoxyethylene (60) sorbite | 10 | | | |
| Example 9 | Hexasteraric acid polyoxyethylene (6) sorbite | 25 | ○ | ○ | 100 |
| | Hexastearic acid polyoxyethylene (40) sorbite | 5 | | | |
| Example 10 | Hexastearic acid polyoxyethylene (6) sorbite | 20 | ○ | ○ | 97 |

TABLE 1-continued

| | Polyoxyethylene sorbite fatty acid ester | Weight parts | A* | B* | C* |
|---|---|---|---|---|---|
| | Hexastearic acid polyoxyethylene (60) sorbite | 10 | | | |
| Comp. Ex. 1 | Hexastearic acid polyoxyethylene (6) sorbite | 4 | x | x | 100 |
| Comp. Ex. 2 | Hexastearic acid polyoxyethylene (6) sorbite | 60 | ○ | ○ | 85 |
| Comp. Ex. 3 | Myristic acid | 30 | x | x | 97 |
| Comp. Ex. 4 | Stearic acid butyl | 30 | x | x | 99 |
| Comp. Ex. 5 | Pentastearic acid hexaglyceryl | 30 | x | x | 100 |
| Comp. Ex. 6 | Phosphoric acid ester | 30 | ○ | ○ | 70 |

TABLE 1-continued

| | Polyoxyethylene sorbite fatty acid ester | Weight parts | A* | B* | C* |
|---|---|---|---|---|---|
| Comp. Ex. 7 | Phosphoric acid ester | 30 | ○ | ○ | 79 |

Notes:
A* . . . Running smoothness
B* . . . Sticking
C* . . . Dye preservation stability As is clear from Table 1, the samples (Examples 1 to 10) using the polyoxyalkylene sorbite fatty acid ester exhibit preferable running smoothness, causing no sticking due to friction increase, enabling to obtain clear images. Moreover, the dye preservation of 95% or above was reached by most of the samples, which has no problem in practice. If the dye preservation is lowered, the color formation is changed, leading to decrease of the transfer concentration. In order to obtain a high quality image, the dye preservation is required to be at least in the order of 90%, and it is preferable to be 95% or above.

Especially in the case when using the hexastearic acid polyoxyethylene (6) sorbite (Examples 1 to 3), the dye preservation of 100% was obtained, which means no adverse affect was caused to the dye layers. This preferable dye preservation enabled to obtain a significantly preferable image formation.

However, when the quantity of the polyoxyalkylene sorbite fatty acid ester added was too small (Comparative Example 1), it was impossible to obtain a sufficient effect, causing trouble in the running smoothness and sticking. On the contrary, when a too much quantity of the polyoxyalkylene sorbite fatty acid ester was added (Comparative Example 2), the dye preservation was lowered.

On the other hand, in the samples using fatty acid and fatty acid ester (Comparative Examples 3 to 5), sticking was caused and it was impossible to obtain a sufficient result.

Moreover, in the samples using phosphoric ester (Comparative Examples 6 and 7), concentration was significantly lowered after preservation and it was impossible to obtain a sufficient result.

EXAMPLES 11 to 13

These Examples 11 to 13 used the polyoxyalkylene sorbite fatty acid ester in combination with the polyglycerin fatty acid ester.

The heat resistant slide layer was replaced by the composition as described below to prepare thermal printing sheets in the same way, retaining the other conditions unchanged.

| Composition of the heat resistant slide layer | | |
|---|---|---|
| Polyvinylacetal resin (trade name: Denkabutyral #3000K produced by Denki Kagaku Kogyou Co., Ltd.) | 100 | weight parts |
| Polyisocyanate (trade name: Colonate L produced by Nippon Polyurethane Kogyou Co., Ltd.) | 20 | weight parts |
| Bulking agent (trade name: KMP-590 produced by Sin'etsu Silicone Co., Ltd.) | 3 | weight parts |
| Organic solvent (methylethylketone:toluene = 1:1) | 1900 | weight parts |
| Polyoxyalkylene sorbite fatty acid ester and polyglycerin fatty acid ester | types and quantities shown in Table 2 | |

It should be noted that the polyoxyalkylene sorbite fatty acid ester used here is the hexastearic acid polyoxy ethylene (6) soribite (trade name: Nikkol GS-6 produced by Nikko Chemicals, Co., Ltd.) and the polyglycerin fatty acid ester is Nikkol Decaglyn-10S (trade name) produced by Nikko Chemicals Co., Ltd.

Comparative Examples 8 to 10

Instead of the polyoxyalkylene sorbite fatty acid ester in combination with the polyglycerin fatty acid ester, polyglycerin fatty ester as a single substance or in combination with phosphoric acid ester was used to prepare the thermal printing sheets in the same way as in Examples 11 to 13.

It should be noted that Comparative Example used polyglycerin fatty acid ester (trade name: Nikkol Decaglyn-10S produced by Nikko Chemicals Co., Ltd.); Comparative Example 7 used phosphoric acid ester (trade name: A208S produced by Daiichi Kogyo Seiyaku Co., Ltd.); and Comparative Example 8 used phosphoric ester (trade name: Phosphanol RD-720 produced by Toho Kagaku Kogyo Co., Ltd.).

Figure 6:
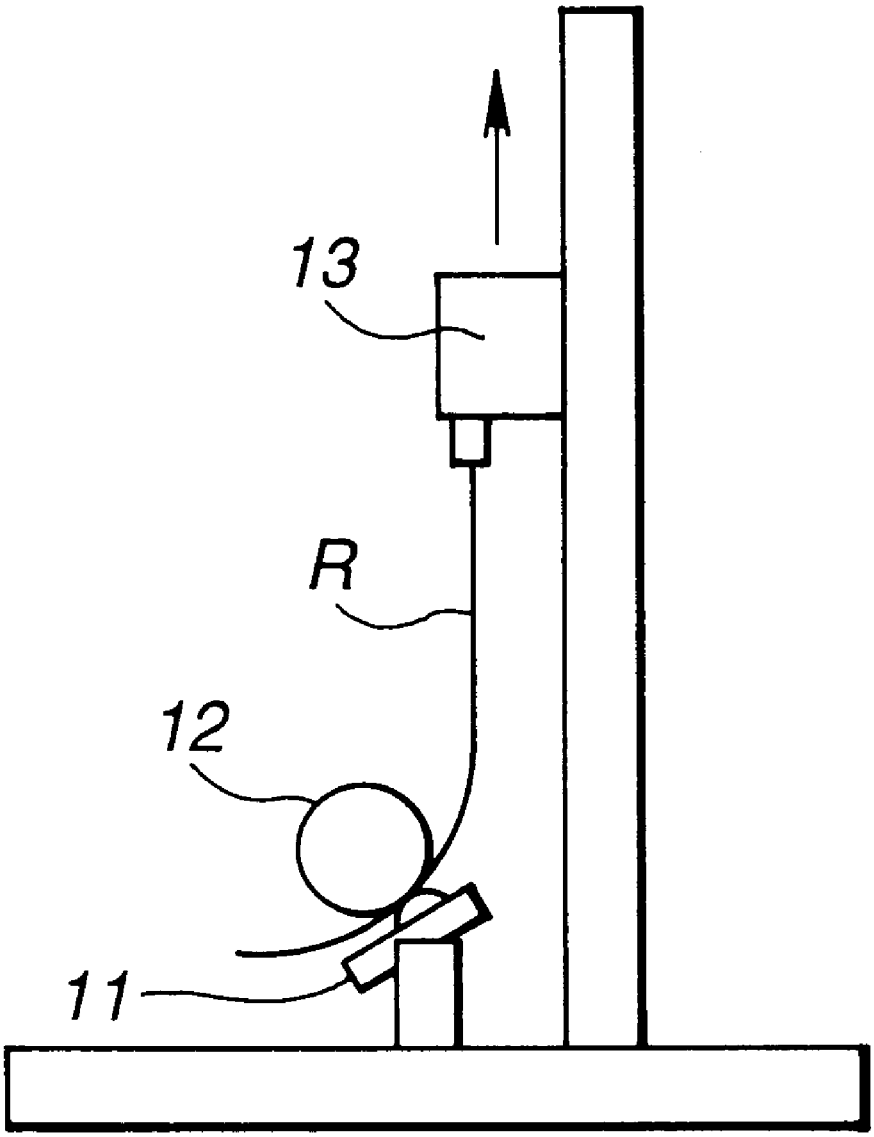
FIG. 6 is a schematic view showing configuration of a friction measuring apparatus.

For these samples, the friction coefficient and the preservation stability were determined. Note that the friction coefficient was determined by using a friction measuring apparatus shown in FIG. 6. For measurement using this apparatus, a thermal printing sheet and a printing paper R were sandwiched with a thermal head 11 and a platen roll 12, and a tension gauge 13 pulls up the thermal printing sheet and the printing paper R so as to determine the tension. The measurement conditions are described below.

Measurement Conditions

Thermal printing sheet feed speed: 450 mm/minute

Signal setting

Print pattern: 2 (stair step)

Original: 3(48/672 lines, 14 steps)

Strobe division: 1
Strobe pulse width: 20.0 msec
Printing speed: 22.0 msec/ 1 line
Clock: 3 ( 4 MHz)

Head voltage: 18.0 V

The dye preservation stability was determined in the same way as has been described above. The results are shown in Table 2.

TABLE 2

| | Lubricant | Weight part | Friction coeffi-cient (min.) | Friction coeffi-cient (max.) | Dye preser-vation |
|---|---|---|---|---|---|
| Example 11 | Polyglycerin fatty acid ester | 15 | 0.16 | 0.17 | 100 |
| | Polyoxyethylene sorbite fatty acid ester | 15 | | | |
| Example 12 | Polyglycerin fatty acid ester | 5 | 0.15 | 0.17 | 100 |
| | Polyoxyethylene sorbite fatty acid ester | 25 | | | |
| Example 13 | Polyglycerin fatty acid ester | 25 | 0.17 | 0.18 | 100 |
| | Polyoxyethylene sorbite fatty acid ester | 5 | | | |
| Comp. Ex. 8 | Polyglycerin fatty acid ester | 30 | 0.15 | 0.19 | 100 |
| Comp. Ex. 9 | Phosphoric acid ester | 30 | 0.17 | 0.17 | 60 |
| Comp. Ex. 10 | Phosphoric acid ester | 30 | 0.16 | 0.16 | 79 |

In the respective Examples, the maximum value of the friction coefficient is reduced in comparison to a case (Example 6) using the polyglycerin fatty acid ester as a single substance. Moreover, the preservation stability is also preferable. However, if a too much quantity of polyglycerin fatty acid is added (Example 15), the friction coefficient is slightly increased.

Moreover, in the samples (Comparative Examples 7 and 8) using the phosphoric ester, the dye preservation stability was lowered although the friction coefficient is reduced.

EXAMPLES 14 to 23

The examples 14 to 23 used mixtures of the polyoxyalkylene sorbite fatty acid ester and the metallic soap.

The composition of the heat resistant slide layer was replaced by the following to prepare thermal printing sheets in the same way as in Example 1, maintaining the other conditions unchanged.

| Composition of the heat resistant slide layer | | |
|---|---|---|
| Polyavinylcetal resin (trade name: Denkabutyral #3000K produced by Denki Kagaku Kogyou Co., Ltd.) | 5.0 | weight parts |
| Polyisocyanate (trade name: Colonate L produced by Nippon Polyurethane Kogyou Co., Ltd.) | 0.5 | weight parts |
| Spherical silica (Tospal 105 produced by Toshiba Silicone Co., Ltd.) | 0.1 | weight parts |

For the aforementioned composition, a mixture of the polyoxyethylene sorbite fatty acid ester and the metallic soap was added in the type, mixture ratio, and quantity shown in Table 3.

The polyoxyethylene sorbite fatty acid ester was mixed with the metallic soap according to a method as follows. Firstly, a necessary quantity of each substance was measured out, and the polyoxyethylene sorbite fatty acid ester (having a lower melting point) was agitated and heated in a $N_2$ atmosphere so as to be solved uniformly. Next, the metallic soap was added to this solution little by little and agitated and heated up to the melting point of the metallic soap so as to be solved uniformly. After this, the mixture solution was cooled down to a room temperature for use as the mixture.

It should be noted that the polyoxyethylene sorbite fatty acid ester used here is the hexastearic acid polyoxyethylene (6) sorbite (trade name: Nikkol GS-6 produced by Nikko Chemicals Co., Ltd.).

Comparative Examples 11 to 15

Instead of the mixture of the polyoxyethylene sorbite fatty acid ester and the metallic soap, iron stearate (III), titanium stearate, pentastearic acid hexaglyceryl or phosphoric acid ester were added to prepare thermal printing sheets in the same way as in Examples 14 to 23.

It should be noted that Comparative Example 13 used as the pentastearic acid hexaglyceryl, Nikkol Hexaglyn-55 (trade name) produced by Nikko Chemicals Co., Ltd.; Comparative Example 14 used as the phosphoric acid ester Phosphanol RD-210 (trade name) produced by Toho Kagaku Kogyo Co., Ltd.; and Comparative Example 15 used as the phosphoric ester, Phosphanol RD-710 (trade name) produced by Toho Chemical Co., Ltd.

For these samples, the running smoothness, sticking, friction coefficient, and the dye preservation stability were determined according to the measurement method which has been described above. Table 3 shows the measurement results. For reference, the results of Example 1 is also shown in the table.

TABLE 3

| | Metallic soap | Lubri-cant | Mixt. ratio | Q* | A* | B* | Min* | Max* | C* |
|---|---|---|---|---|---|---|---|---|---|
| Ex. 1 | — | P* | — | 30 | ○ | ○ | 0.16 | 0.17 | 100 |
| Ex. 14 | Iron stearate (III) | P* | 0.1/ 10.0 | 20 | ○ | ○ | 0.13 | 0.13 | 100 |
| Ex. | Iron | P* | 1.0/ | 20 | ○ | ○ | 0.12 | 0.12 | 100 |

TABLE 3-continued

| | Metallic soap | Lubricant | Mixt. ratio | Q* | A* | B* | Min* | Max* | C* |
|---|---|---|---|---|---|---|---|---|---|
| 15 | stearate (III) | | 10.0 | | | | | | |
| Ex. 16 | Iron stearate (III) | P* | 1.0/ 1.0 | 20 | ○ | ○ | 0.13 | 0.13 | 100 |
| Ex. 17 | Iron stearate (III) | P* | 1.0/ 10.0 | 30 | ○ | ○ | 0.12 | 0.12 | 100 |
| Ex. 18 | Aluminium stearate | P* | 0.5/ 10.0 | 20 | ○ | ○ | 0.14 | 0.14 | 100 |
| Ex. 19 | Copper strearate | P* | 0.5/ 10.0 | 20 ○ | ○ | ○ | 0.14 | 0.14 | 100 |
| Ex. 20 | Titanium stearate | P* | 1.0/ 10.0 | 30 | ○ | ○ | 0.14 | 0.14 | 100 |
| Ex. 21 | Hydroxy-stearate | P* | 0.3/ 0.1/ 10 | 20 | ○ | ○ | 0.15 | 0.15 | 100 |
| Ex. 22 | Iron stearate (III), Copper stearate | P* | 0.25/ 0.25/ 10 | 20 | ○ | ○ | 0.13 | 0.13 | 100 |
| Ex. 23 | Copper stearate, Aluminium stearate | P* | — | 20 | ○ | ○ | 0.14 | 0.14 | 100 |
| Com. Ex. 11 | Iron stearate (III) | — | — | 20 | x | x | 0.18 | 0.2 | 100 |
| Com. Ex. 12 | Titanium stearate | — | — | 20 | x | x | 0.2 | 0.25 | 100 |
| Com. Ex. 13 | — | Pentastearic acid hexaglyceryl | — | 30 | x | x | 0.19 | 0.25 | 100 |
| Com. Ex. 14 | — | Phosphoric acid ester | — | 30 | ○ | ○ | 0.17 | 0.17 | 60 |
| Com. Ex. 15 | — | Phosphoric acid ester | — | 30 | ○ | ○ | 0.16 | 0.16 | 79 |

Notes:
P*: Polyoxyethylene sorbite fatty acid ester
Q*: Weight parts
A*: Running smoothness
B*: Sticking
Min*: Minimum friction coefficient
Max*: Maximum friction coefficient
C*: Dye preservation stability Table 3 shows that the samples using the mixture of the polyoxyethylene sorbite fatty acid ester and the metallic soap (Examples 14 to 23) exhibited preferable running smoothness without sticking due to friction increase, enabling to obtain clear images. Especially in the cases using the mixture (Examples 14 to 23), it was possible to reduce the friction coefficient in both of the maximum value (higher gradation steps) and the minimum value (lower gradation steps) without any difference between them, enabling to obtain a stable running.

On the other hand, when the metallic soap was used as a single substance (Comparative Examples 11 and 12), sticking was caused, disabling to obtain a sufficient result. Moreover, when the pentastearic acid hexaglyceryl was used (Comparative Example 13), the friction coefficient was high and a great difference was present between the maximum value and the minimum value of the friction coefficient. When the phosphoric acid ester was used (Comparative Examples 14 and 15), the concentration was lowered, disabling to obtain a sufficient result.

As is clear from the aforementioned, according to the present invention, the use of polyoxyalkylene sorbite fatty acid ester in the heat resistant slide layer enables to obtain a thermal printing sheet exhibiting a superior running smoothness and dye preservation stability, enabling to obtain a clear image.

What is claimed is:

1. A thermal printing sheet comprising a substrate sheet, on one side of which is formed a thermal dye layer and on the other side of which is formed a heat resistant slide layer containing a polyoxyalkylene sorbite fatty acid ester expressed by Chemical Formula 1 give below:

Chemical Formula 1

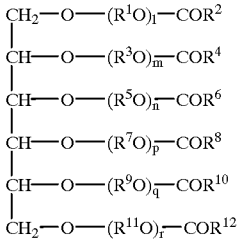

wherein, $R^1$, $R^3$, $R^5$, $R^7$, $R^9$, and $R^{11}$ represent straight chain or branched chain alkyl groups of $C_2$ to $C_{10}$; $R^2$, $R^4$, $R^6$, $R^8$, $R^{10}$, and $R^{12}$ represent straight chain acyl groups of $C_{12}$ to $C_{30}$; l, m, n, p, q, and r are integers from 0 to 100 excluding a case when all of l, m, n, o, p, q, and r are zero.

2. A thermal printing sheet as claimed in claim 1, wherein said heat resistant slide layer contains 5 to 50 weight % of said polyoxyalkylene sorbite fatty acid ester.

3. A thermal printing sheet as claimed in claim 1, wherein said polyalkylene sorbite fatty acid ester is a stearic acid ester.

4. A thermal printing sheet as claimed in claim 1, wherein said polyoxyalkylene sorbite fatty acid ester has "6" for the number of the oxyalkylene chains l, m, n, p, q, and r.

5. A thermal printing sheet as claimed in claim 1, wherein said heat resistant slide layer contains polyglycerin fatty acid ester.

6. A thermal printing sheet as claimed in claim 5, wherein said polyglycerin fatty acid ester is contained by 50 weight % or below with respect to a total together with the polyoxyalkylene sorbite fatty acid ester.

7. A thermal printing sheet as claimed in claim 1, wherein said heat resistant slide layer contains a mixture of said polyoxyalkylene sorbite fatty acid ester and a metallic soap expressed by Chemical Formula 2 given below:

$$(R^{13}COO)_nM\cdot X(H_2O)$$

wherein $R^{13}$ represent a straight chain or branched chain alkyl group of $C_6$ to $C_{29}$ or alkyl group partially replaced by a hydroxyl group, amine, halogen group; n is an integer 1 to 4; M is a divalent to tetravalent metal; and X is an integer 0 to 4.

8. A thermal printing sheet as claimed in claim 7, wherein said polyoxyalkylene sorbite fatty acid ester and a hydrate of the metallic soap are mixed with a mixing ratio of 10:0.01 to 1:1 by weight parts.

9. A thermal printing sheet as claimed in claim 7, wherein said metallic soap has a functional group $R^{13}$ as $C_{17}H_{35}$.

10. A thermal printing sheet as claimed in claim 1, wherein said heat resistant slide layer contains a thermoplastic resin which is bridged by polyisocyanate.

11. A thermal printing sheet as claimed in claim 10, wherein said thermoplastic resin is a polyvinyl butyral resin.

* * * * *